US010175618B2

(12) United States Patent
Sato et al.

(10) Patent No.: US 10,175,618 B2
(45) Date of Patent: Jan. 8, 2019

(54) FIXING DEVICE AND IMAGE FORMING APPARATUS

(71) Applicant: FUJI XEROX CO., LTD., Tokyo (JP)

(72) Inventors: Hideki Sato, Kanagawa (JP); Jun Sawamura, Kanagawa (JP); Yoshiro Konishi, Kanagawa (JP); Yasuhiro Kato, Kanagawa (JP); Takayuki Ukawa, Kanagawa (JP); Masahiro Akatsuka, Kanagawa (JP); Yusuke Sakurai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/795,268

(22) Filed: Oct. 27, 2017

(65) Prior Publication Data

US 2018/0196379 A1 Jul. 12, 2018

(30) Foreign Application Priority Data

Jan. 12, 2017 (JP) ..... 2017-003228

(51) Int. Cl.

| | |
|---|---|
| ***G03G 15/16*** | (2006.01) |
| ***G03G 15/20*** | (2006.01) |
| ***G03G 9/08*** | (2006.01) |

(52) U.S. Cl.

CPC ..... *G03G 15/2032* (2013.01); *G03G 9/0821* (2013.01); *G03G 9/0825* (2013.01); *G03G 15/206* (2013.01); *G03G 15/2064* (2013.01)

(58) Field of Classification Search

CPC ..... G03G 9/0821; G03G 9/0825; G03G 15/2032; G03G 15/2067; G03G 15/2089; G03G 15/206; G03G 15/2064

See application file for complete search history.

(56) References Cited

FOREIGN PATENT DOCUMENTS

JP 2013-242481 12/2013

*Primary Examiner* — Hoang Ngo
(74) *Attorney, Agent, or Firm* — JCIPRNET

(57) ABSTRACT

A fixing device includes a first fixing member, a second fixing member that fixes a toner image transferred to a recording medium onto the recording medium by transporting the recording medium while holding the recording medium between the first fixing member and the second fixing member, a first support member that supports the first fixing member, a forcing member that supports the second fixing member and presses the second fixing member against the first fixing member, and a restricting member disposed on the first support member to fix a position of the first support member at an attachable member to which the first support member is attached, and to restrict a position of the forcing member.

12 Claims, 16 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2017-003228 filed Jan. 12, 2017.

BACKGROUND

Technical Field

The present invention relates to a fixing device and an image forming apparatus.

SUMMARY

According to an aspect of the invention, a fixing device includes a first fixing member, a second fixing member that fixes a toner image transferred to a recording medium onto the recording medium by transporting the recording medium while holding the recording medium between the first fixing member and the second fixing member, a first support member that supports the first fixing member, a forcing member that supports the second fixing member and presses the second fixing member against the first fixing member, and a restricting member disposed on the first support member to fix a position of the first support member at an attachable member to which the first support member is attached, and to restrict a position of the forcing member.

BRIEF DESCRIPTION OF THE DRAWINGS

Exemplary embodiments of the present invention will be described in detail based on the following figures, wherein.

DETAILED DESCRIPTION

Now, exemplary embodiments of the present invention are described below.

Description of Image Forming Apparatus

Figure 1:
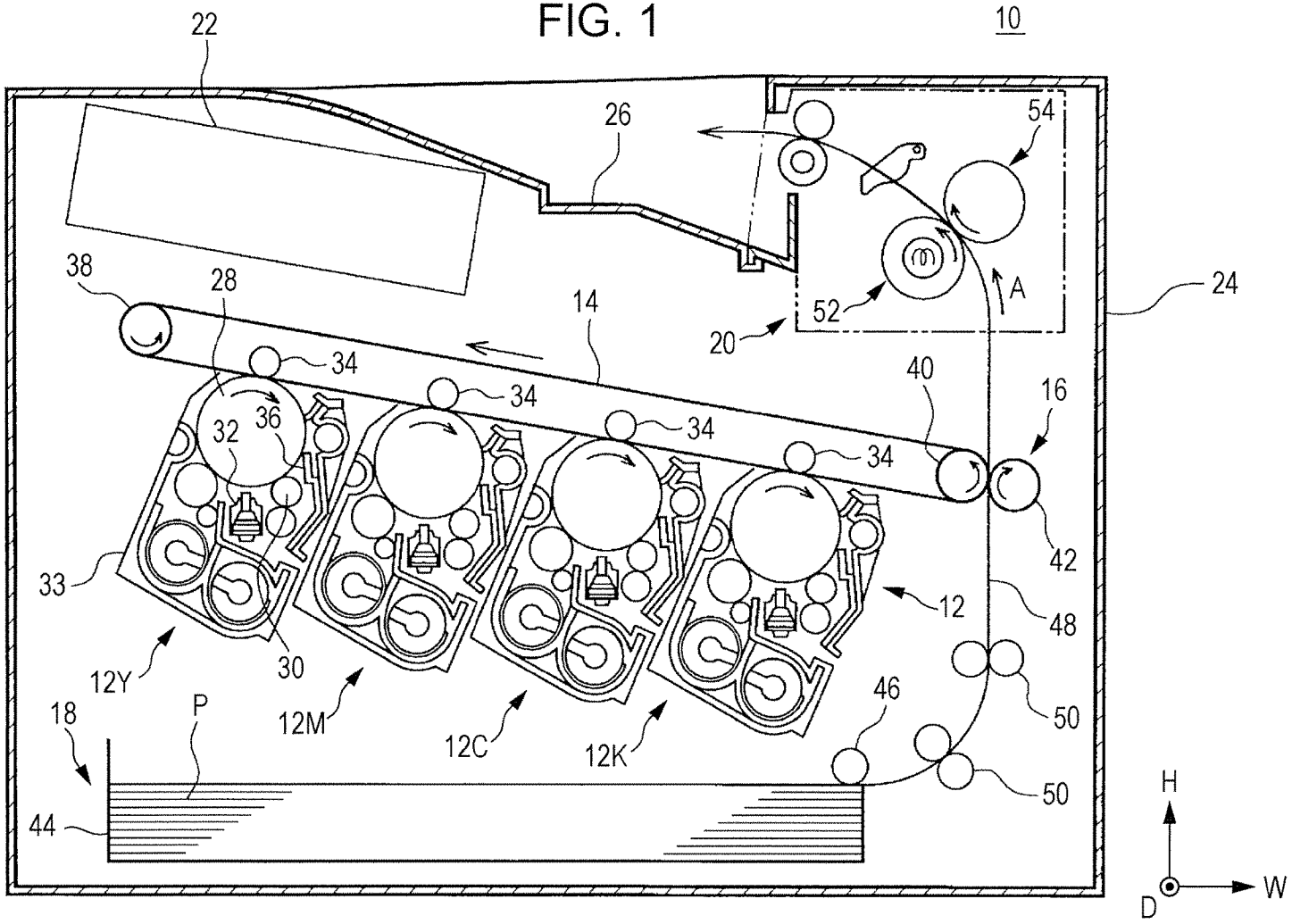
FIG. 1 illustrates an image forming apparatus according to an exemplary embodiment of the present invention.

FIG. 1 illustrates an example of an image forming apparatus according to an exemplary embodiment. FIG. 1 is a schematic diagram of the schematic structure of an image forming apparatus 10 according to an exemplary embodiment. The image forming apparatus 10 is, for example, an electrophotographic apparatus having a printing function and a photocopying function. The image forming apparatus 10 may include a postprocessing device that performs post-processing, such as punching or stapling, on a sheet P, serving as a recording medium.

In the following description, the direction of arrow H in FIG. 1 is referred to as an apparatus height direction, the direction of arrow W in FIG. 1 is referred to as an apparatus width direction, and the direction of arrow D is referred to as an apparatus depth direction. The apparatus height direction H, the apparatus width direction W, and the apparatus depth direction D are perpendicular to each other.

The image forming apparatus 10 includes an image forming portion 12, an intermediate transfer belt 14, a second transfer device 16, a sheet feeding portion 18, a fixing device 20, and a controller 22. The image forming portion 12 has a function of forming images. The intermediate transfer belt 14 allows images formed by the image forming portion 12 to be first-transferred thereto. The second transfer device 16 has a function of second-transferring images first-transferred to the intermediate transfer belt 14 to a sheet P, serving as a recording medium. The sheet feeding portion 18 has a function of feeding sheets P toward the second transfer device 16. The fixing device 20 has a function of fixing images second-transferred to a sheet P by the second transfer device 16 to the sheet P. The controller 22 has a function of controlling the operations of the components constituting the image forming apparatus 10. The image forming apparatus 10 also includes a housing body 24, which holds these components. The image forming apparatus 10 includes, at an upper portion of the housing body 24, a sheet tray portion 26, which allows sheets P to which images have been fixed as a result of passing through the fixing device 20 to be stacked thereon. Now, each component is described in details.

The image forming portion 12 includes, for example, multiple image forming units 12Y, 12M, 12C, and 12K. The image forming units 12Y, 12M, 12C, and 12K have a function of forming toner images of the respective colors by, for example, electrophotography. The image forming units 12Y, 12M, 12C, and 12K are arranged side by side so as to face the intermediate transfer belt 14. The multiple image forming units 12Y, 12M, 12C, and 12K respectively have functions of forming images of yellow, magenta, cyan, and black.

The multiple image forming units 12Y, 12M, 12C, and 12K each include a photoconductor drum 28 (image carrier), which rotates in the direction indicated by the corresponding arrow in FIG. 1. Each of the image forming units 12Y, 12M, 12C, and 12K includes, around the corresponding photoconductor drum 28, a charging device 30, which charges the photoconductor drum 28, an exposure device 32, which exposes the photoconductor drum 28 to light to form an electrostatic latent image on the photoconductor drum 28, and a developing device 33, which develops the electrostatic latent image on the photoconductor drum 28 with toner of the corresponding color into a toner image. Each of the image forming units 12Y, 12M, 12C, and 12K also includes a first transfer device 34, which transfers the toner image of the corresponding color on the corresponding photoconductor drum 28 to the intermediate transfer belt 14, and a drum cleaning device 36, which removes toner remaining on the photoconductor drum 28.

The intermediate transfer belt 14 is wound around two rotatable roller members 38 and 40 so as to rotate in the direction of the arrow in FIG. 1. For example, the roller member 38 drives the intermediate transfer belt 14. The roller member 40 is disposed so as to face a second transfer roller 42 with the intermediate transfer belt 14 interposed therebetween. The second transfer roller 42 and the roller member 40 constitute the second transfer device 16. A belt cleaning device (not illustrated) that removes toner remaining on the intermediate transfer belt 14 is disposed at such a position as to face the roller member 38 with the intermediate transfer belt 14 interposed therebetween.

The sheet feeding portion 18 is disposed below the image forming portion 12 and includes a sheet storage 44, a pickup roller 46, a transport path 48, and transporting rollers 50. The sheet storage 44 holds sheets P. The sheets P held in the sheet storage 44 are fed to the transport path 48 by the pickup roller 46 and transported through the transport path 48 by the transporting rollers 50. The transport path 48 extends inside the housing body 24 from the sheet storage 44 to the sheet tray portion 26 via the second transfer device 16 and the fixing device 20.

The fixing device 20 includes a heating member 52 and a pressing member 54. The fixing device 20 has a function of fixing the toner image formed on a sheet P by the image forming portion 12 onto the sheet P by pressing the toner image while heating the toner image. The direction of arrow A illustrated in FIG. 1 denotes the direction in which the sheets P are transported.

The operation of the image forming apparatus 10 is described below.

Upon receipt of image information from an external device, not illustrated, the controller 22 generates exposure data based on image information, outputs the data to each of the exposure devices 32 of the image forming portion 12, and outputs control signals to the components of the image forming apparatus 10 to start their operations.

For example, in the yellow (Y) image forming unit 12Y, the photoconductor drum 28 driven to rotate in the direction of the arrow in FIG. 1 is charged by the charging device 30 and exposed to light by the exposure device 32, which emits light based on the exposure date fed from the controller 22. Thus, an electrostatic latent image related to a yellow image is formed on the photoconductor drum 28. The electrostatic latent image formed on the photoconductor drum 28 is developed by the developing device 33, so that a yellow toner image is formed on the photoconductor drum 28. Similarly, also in each of the image forming units 12M, 12C, and 12K, a magenta (M), cyan (C), or black (K) toner image is formed in the above-described procedure.

Toner images formed on the photoconductor drums 28 of the image forming units 12Y, 12M, 12C, and 12K are first-transferred (electrostatically transferred) to the intermediate transfer belt 14, which is driven to rotate in the direction of the arrow in FIG. 1, by the first transfer devices 34, and superposed one on top of another on the intermediate transfer belt 14. The toner images superposed one on top of another on the intermediate transfer belt 14 are transported by the rotation of the intermediate transfer belt 14 to a second transfer position at which the second transfer device 16 is disposed. Toner remaining on each photoconductor drum 28 after the first transfer is removed by the drum cleaning device 36 of the corresponding one of the image forming units 12Y, 12M, 12C, and 12K.

In the sheet feeding portion 18, the sheets P held in the sheet storage 44 are picked up one by one by the pickup roller 46 and fed to the transport path 48. The transporting rollers 50 disposed on the transport path 48 transport each sheet P from the sheet storage 44 toward the second transfer position at a timing at which the superposed toner images on the intermediate transfer belt 14 arrive at the second transfer position.

The toner images on the intermediate transfer belt 14 are second-transferred (electrostatically transferred) by the second transfer device 16 to the sheet P that passes by the second transfer position. At this time, the toner image is second-transferred to the surface of the sheet P facing the intermediate transfer belt 14.

While the sheet P to which the toner images have been transferred passes through the fixing device 20, the surface of the sheet P carrying the toner images is heated by the heating member 52, and the sheet P is pressed by the heating member 52 and the pressing member 54, so that the toner images are fixed to the sheet P. Thereafter, the sheet P to which the toner images are fixed as a result of passing through the fixing device 20 is discharged to the sheet tray portion 26. Toner remaining on the intermediate transfer belt 14 after the sheet P has passed by the second transfer position is removed by a belt cleaning device (not illustrated).

As long as including the fixing device 20, the structure of the image forming apparatus 10 according to the present exemplary embodiment is not limited to the above-described structure. The image forming apparatus 10 may be, for example, an apparatus having a function of forming images using specific colors other than yellow, magenta, cyan, and black (for example, a transparent toner, a white toner, a gold toner, a silver toner, or other toner), or an apparatus having a function of forming monochrome images without having a function of forming color images (in this case, a black (K) toner is used as toner).

Description of Fixing Device 20

The fixing device 20 is described in detail below.

Figure 2:
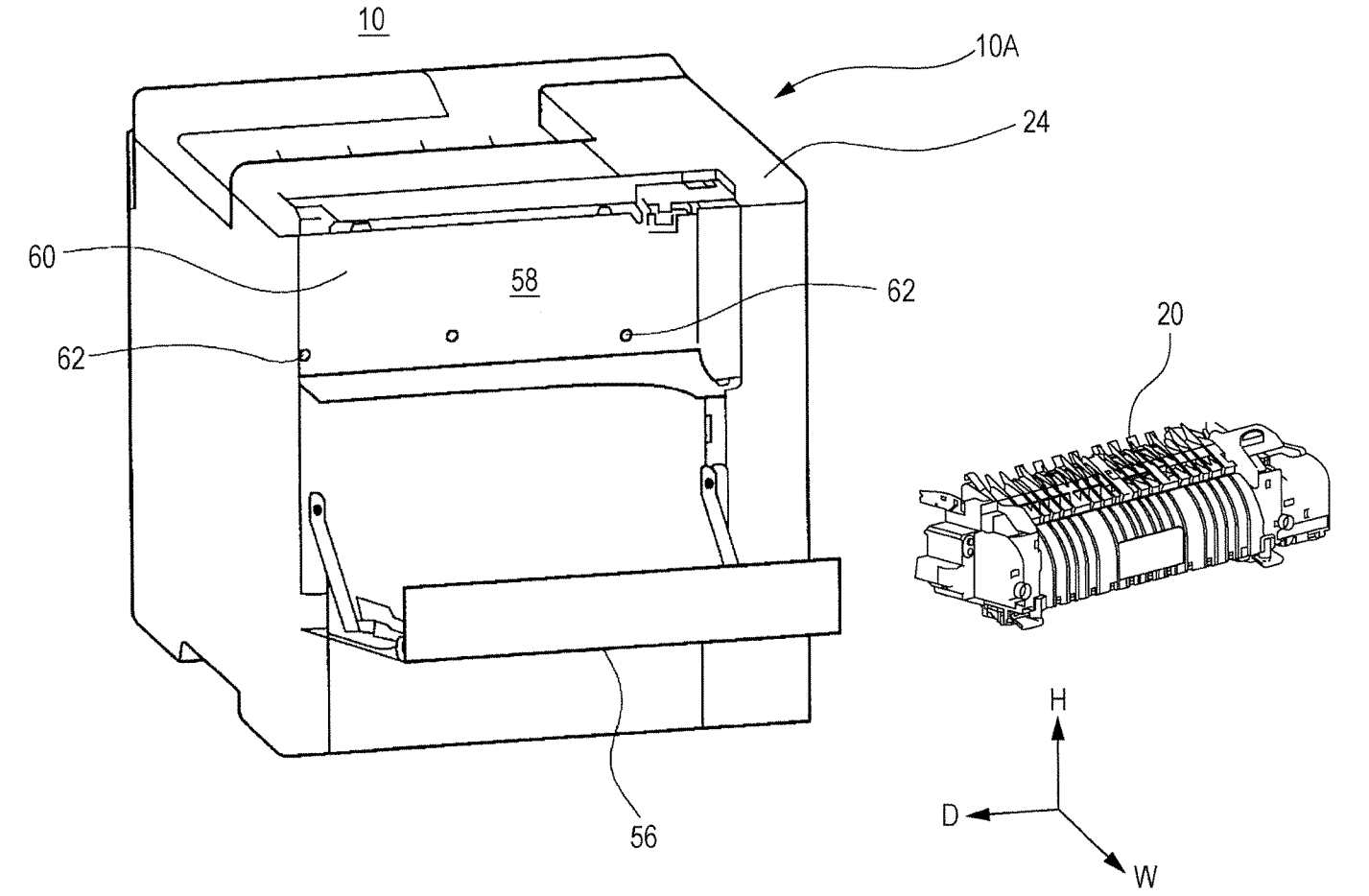
FIG. 2 is a perspective view of the appearance of the image forming apparatus.
Figure 3:
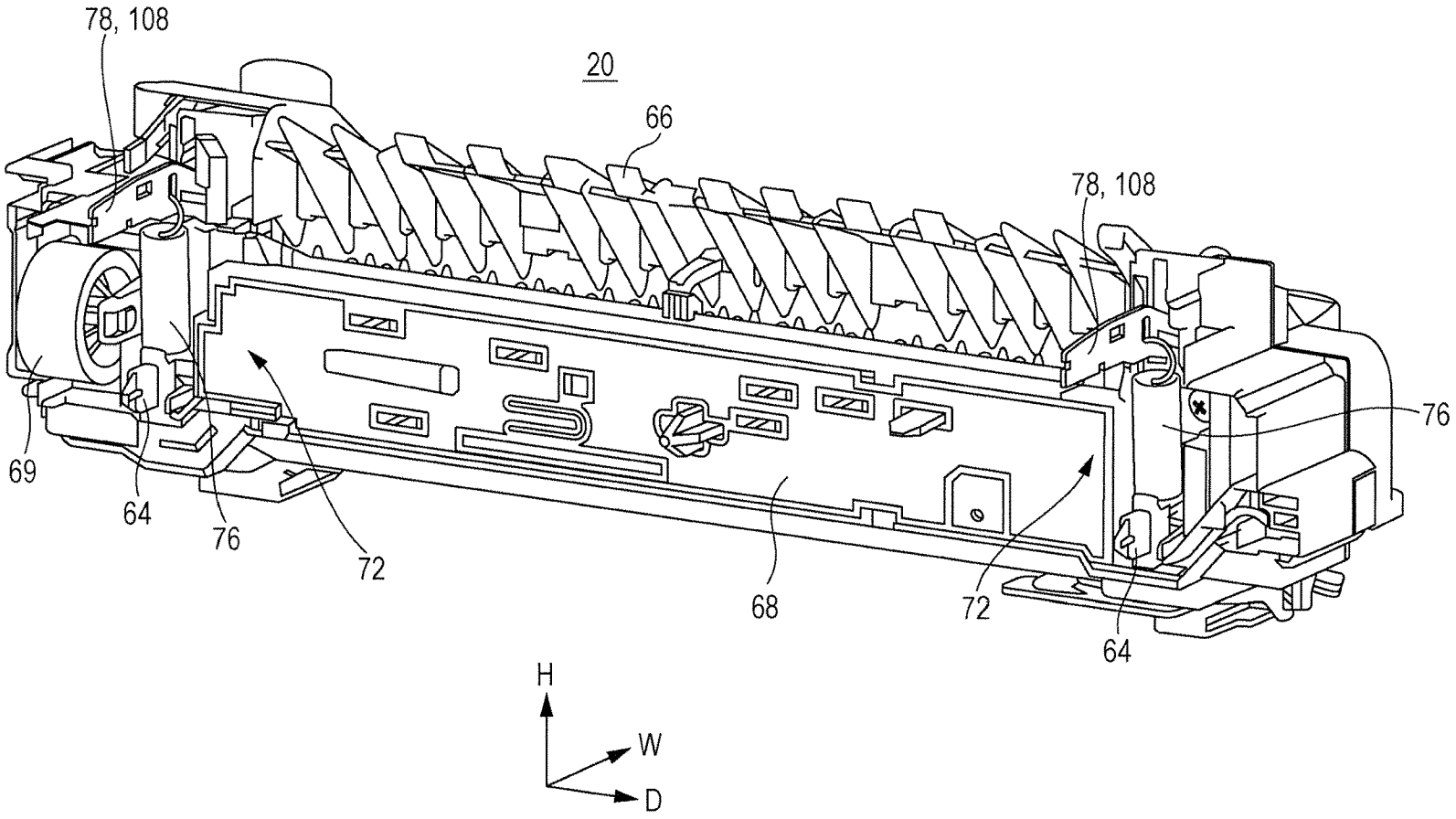
FIG. 3 is a perspective view of the appearance of a fixing device.

With reference to FIGS. 2 and 3, the appearance of the image forming apparatus 10 and the appearance of the fixing device 20 are described. FIG. 2 is a perspective view of the appearance of the image forming apparatus 10. FIG. 3 is a perspective view of the appearance of the fixing device 20.

The fixing device 20 is removable from an image forming apparatus body 10A (the portion of the image forming apparatus 10 at least excluding the fixing device 20), corresponding to an example of an attachable member. As illustrated in FIG. 2, the housing body 24 includes a maintenance door 56 to allow the fixing device 20 to be removed from the image forming apparatus body 10A through the opened maintenance door 56. The housing body 24 defines a space 58 that allows the fixing device 20 to be placed therein. The fixing device 20 is disposed in the space 58. Two attachment grooves 62 (recesses) are formed in a body wall 60, defining the space 58, while being spaced apart from each other in the apparatus depth direction D. The attachment grooves 62 correspond to an example of restricting portions of the image forming apparatus body 10A, serving as an attachable member.

As illustrated in FIG. 3, the fixing device 20 includes two restricting members 64, which are spaced apart from each other in the apparatus depth direction D. Each restricting member 64 has a shape protruding from the fixing device 20. The attachment grooves 62 illustrated in FIG. 2 are located in the body wall 60 so as to correspond to the respective restricting members 64 of the fixing device 20. When the fixing device 20 is placed in the space 58, the restricting members 64 of the fixing device 20 are fitted into the corresponding attachment grooves 62. The position (movement) of the fixing device 20 with respect to the image forming apparatus body 10A is restricted as a result of the restricting members 64 and the corresponding attachment grooves 62 being fitted to each other, and the position of the fixing device 20 relative to the image forming apparatus body 10A is fixed. The restricting members 64 disposed on the fixing device 20 function as a position fixing member of the fixing device 20. The restricting members 64 are described in detail below. Alternatively, grooves (recesses) may be formed in the restricting members 64 and protrusions may be disposed on the image forming apparatus body 10A to serve as restricting portions. In this case, the position (movement) of the fixing device 20 with respect to the image forming apparatus body 10A may be restricted as a result of the grooves formed in the restricting members 64 and the protrusions disposed on the image forming apparatus body 10A being fitted to each other.

As illustrated in FIG. 3, the fixing device 20 includes coverings 66 and 68. The heating member 52 and the pressing member 54 are covered with the coverings 66 and 68 and held in the space defined by the coverings 66 and 68.

FIG. 3 illustrates part of forcing members 72 (part of springs 76 and forcing plates 78, or an operation member 108), which presses (urges) the pressing member 54 against the heating member 52. The forcing members 72 are described in detail below. FIG. 3 illustrates a gear 69, which transmits rotational force from a driving motor (not illustrated) to the heating member 52.

Figure 4:
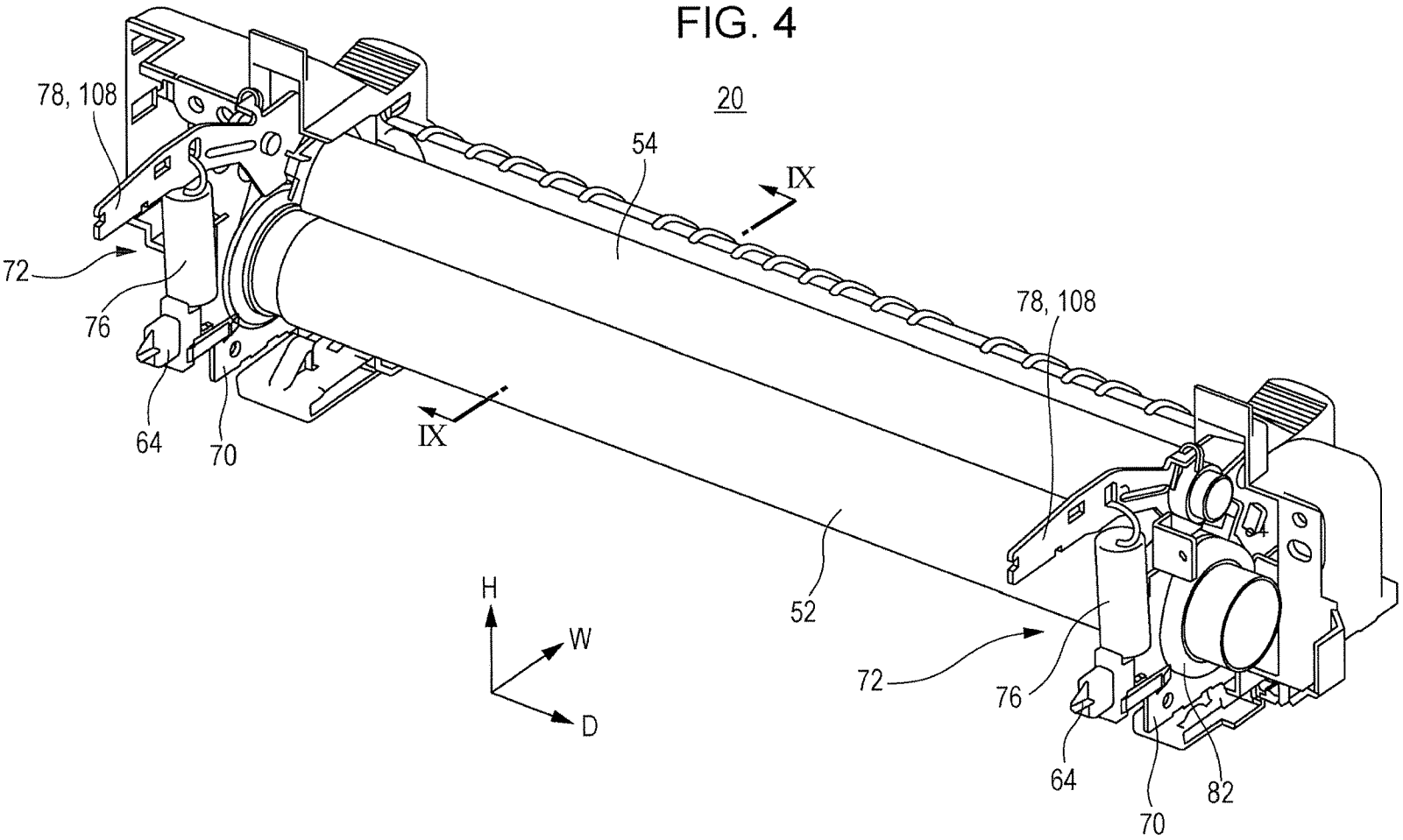
FIG. 4 is a perspective view of a fixing device.
Figure 5:
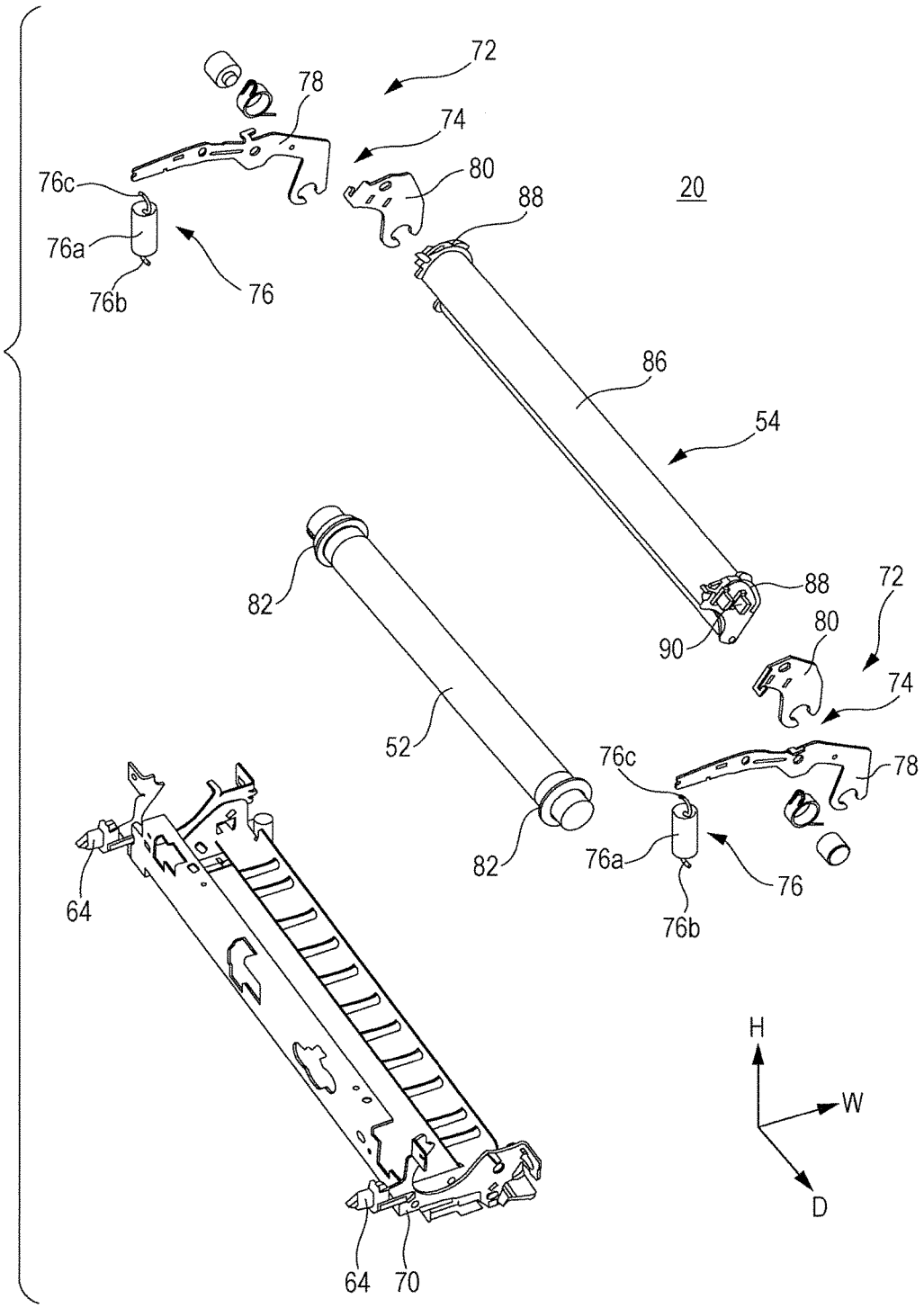
FIG. 5 is an exploded perspective view of a fixing device.

FIGS. 4 and 5 illustrate the fixing device 20 from which the coverings 66 and 68 are removed. FIG. 4 is a perspective view of the fixing device 20 and FIG. 5 is an exploded perspective view of the fixing device 20.

The fixing device 20 includes a heating member 52, a first support member 70, which supports the heating member 52, a pressing member 54, and a pair of forcing members 72 (urging members), which support the pressing member 54 and press (urge) the pressing member 54 toward the heating member 52. The pair of forcing members 72 include a pair of second support members 74 and a pair of springs 76. The second support members 74 each include a forcing plate 78 and a guiding plate 80. The pair of second support members 74 are supported by the first support member 70 so as to be movable relative to the first support member 70. The pressing member 54 is supported by the pair of second support members 74. The pair of springs 76 are elastic members that press the pressing member 54 against the heating member 52, for example, coil springs. Naturally, components other than springs may be used as elastic members.

Figure 6:
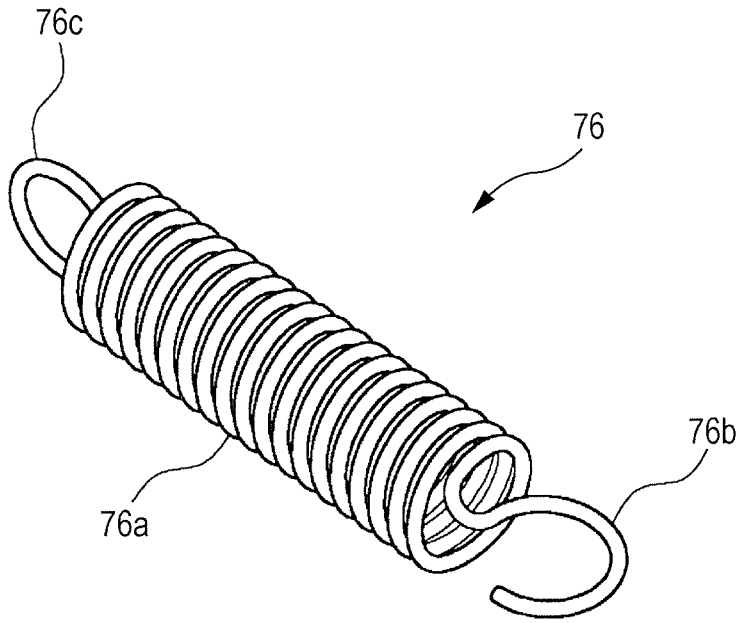
FIG. 6 is a perspective view of a spring.

FIGS. 4 and 5 schematically illustrate the springs 76. FIG. 6 illustrates the more detailed structure of one of the springs 76. FIG. 6 is a perspective view of the spring. Each spring 76 includes a spring body 76*a*, functioning as an elastic member, a first coupling member 76*b*, disposed at a first end of the spring body 76*a*, and a second coupling member 76*c*, disposed at a second end of the spring body 76*a*. The first coupling member 76*b* and the second coupling member 76*c* have a shape of a hook, such as a letter C shaped hook. In the drawings other than FIG. 6, each spring 76 is schematically illustrated, but the spring 76 has, for example, the structure illustrated in FIG. 6.

The heating member 52 includes a hollow cylindrical member, extending in the apparatus depth direction D and having a hollow cylinder shape whose rotation axis extends in the apparatus depth direction D, a heating portion, such as a halogen lamp, disposed in the space of the hollow cylindrical member, and a pair of bearings 82, disposed on both end portions of the hollow cylindrical member in the apparatus depth direction D. The bearings 82 have a hollow cylindrical shape and are fitted to the outer circumferential surface of the hollow cylindrical member. Both end portions of the heating member 52 in the rotational axis direction (apparatus depth direction D) protrude from both end portions of the hollow cylindrical member in the rotational axis direction and are held (supported) by the first support member 70. Both end portions of the heating member 52 in the rotational axis direction are rotatably supported by bearings held by the first support member 70. The heating member 52 rotates with the rotational force transmitted from a driving motor (not illustrated) through a gear 69 (see FIG. 3) held by the first end portion in the rotational axis direction. The apparatus depth direction D (rotational axis direction) corresponds to the direction crossing the transportation direction A of the sheet P.

The first support member 70 is a member (member extending in the apparatus depth direction D) that functions as part of a frame of the fixing device 20 and has a length extending in the rotational axis direction (apparatus depth direction D) of the heating member 52. Portions that allow the springs 76 to be hooked thereon are formed at both end portions of the first support member 70 in the apparatus depth direction D.

The restricting members 64 are disposed on the first support member 70 on both ends in the apparatus depth direction D and extend in the apparatus width direction W. Each restricting member 64 has, for example, a shape protruding from the first support member 70 in the apparatus width direction W. The restricting members 64 are removable from the first support member 70.

The pressing member 54 includes a hollow cylindrical pressing belt 86 and a pair of coverings 88 disposed at both ends of the pressing belt 86 in the apparatus depth direction D to close the openings of the pressing belt 86. The pressing belt 86 extends in the apparatus depth direction D. An end portion 90 of a support member 92, described below, protrudes from each covering 88 in the apparatus depth direction D.

Figure 7:
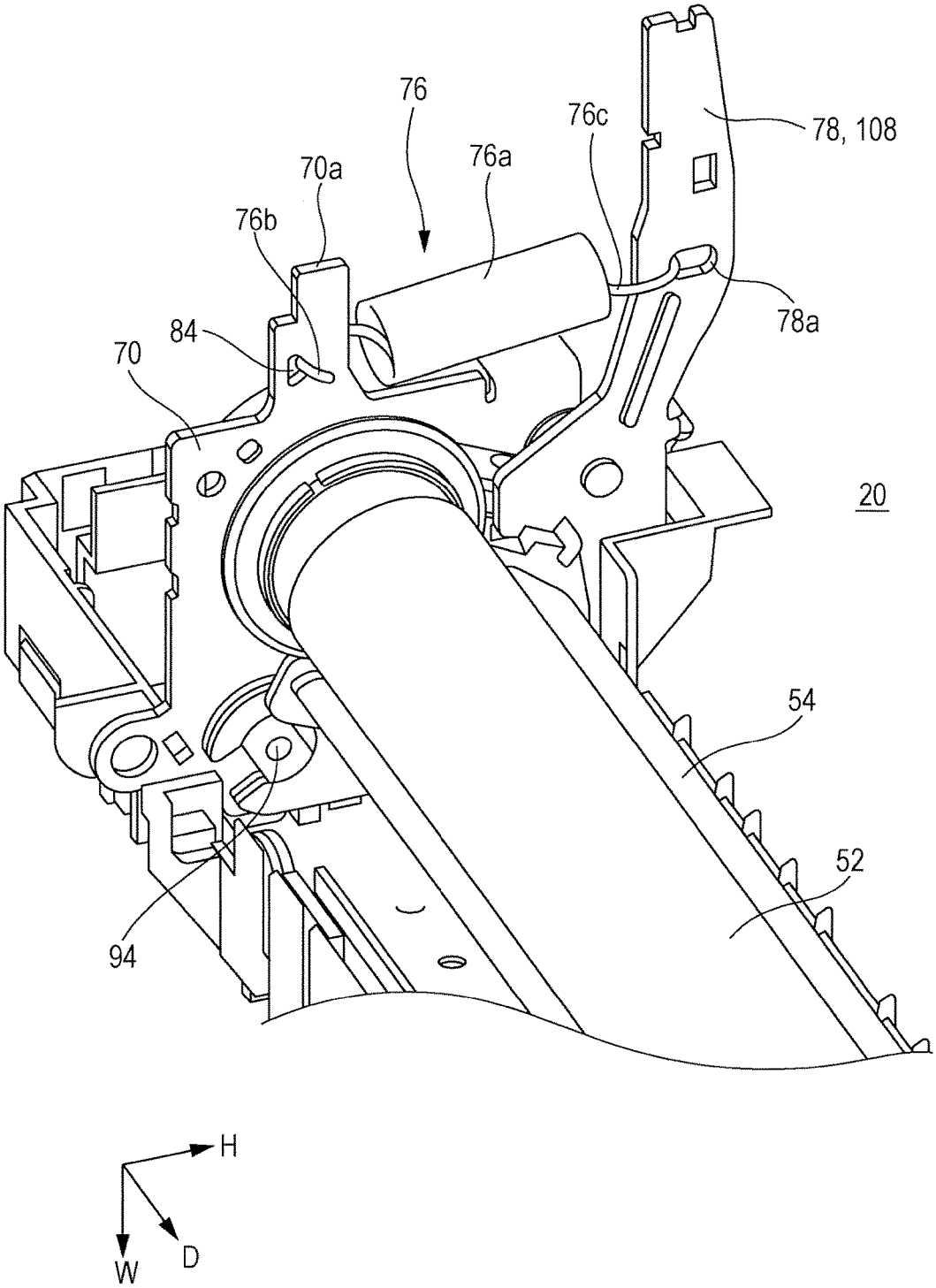
FIG. 7 is a perspective view of a portion of a fixing device.

FIG. 7 illustrates a portion of the fixing device 20 (a first end portion in the apparatus depth direction D). FIG. 7 is a perspective view of a portion of the fixing device 20. The first support member 70 includes, at both end portions in the apparatus depth direction D, protrusions 70*a* which protrude in the apparatus width direction W. Each protrusion 70*a* has a hook catcher 84 on which the first coupling member 76*b* of the corresponding spring 76 is allowed to be hooked (coupled). FIG. 7 illustrates the fixing device 20 in which the restricting members 64 are removed from the first support member 70. As described below, the restricting members 64 are attached to the protrusions 70*a*. Each hook catcher 84 is, for example, a through hole formed in the first support member 70. Instead of the through hole, the hook catcher 84 may be, for example, a protrusion on which the first coupling member 76*b* is allowed to be hooked. Each forcing plate 78 constituting the corresponding second support member 74 has a hook catcher 78*a*, on which the second coupling member 76*c* of the corresponding spring 76 is hooked (coupled). The hook catcher 78*a* is, for example, a through hole formed in, for example, the forcing plate 78. Instead of the through hole, the hook catcher 78*a* may be, for example, a protrusion on which the second coupling member 76*c* is allowed to be hooked. As described above, the first coupling member 76*b* of each spring 76 is hooked on the first support member 70, which supports the heating member 52, and the second coupling member 76*c* of each spring 76 is hooked on the forcing plate 78 constituting the corresponding second support member 74, which supports the pressing member 54.

Figure 8:
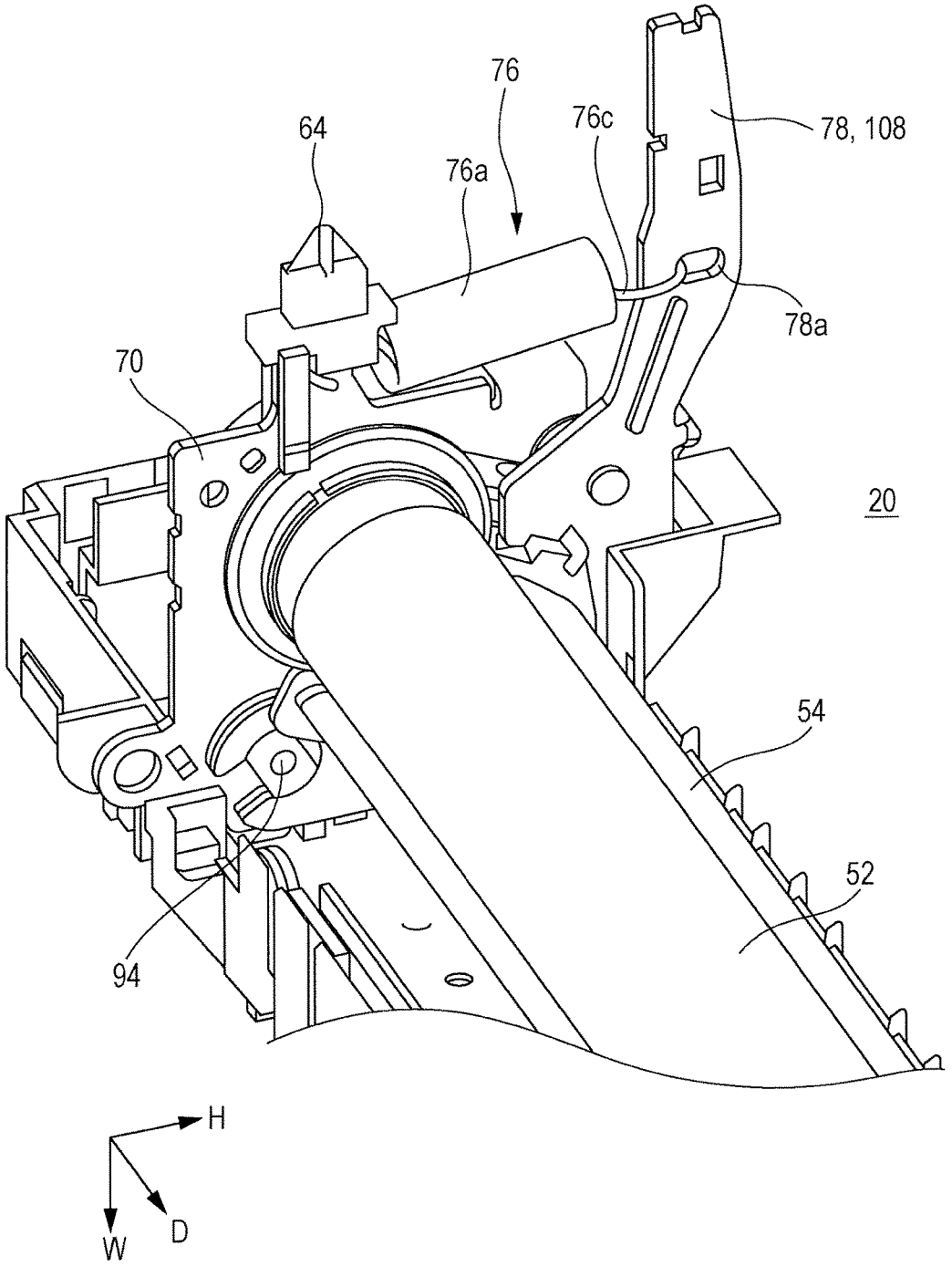
FIG. 8 is a perspective view of a portion of a fixing device.

FIG. 8 illustrates the fixing device 20 to which one restricting member 64 is attached. FIG. 8 is a perspective view of a portion of the fixing device 20. Each restricting member 64 is attached to the corresponding protrusion 70*a* (see FIG. 7) of the first support member 70 so as to cover the first coupling member 76*b* of the corresponding spring 76. The restricting member 64 has a portion that protrudes in a direction away from the fixing device 20 (in the apparatus width direction W). When the fixing device 20 is attached to the image forming apparatus body 10A illustrated in FIG. 2, the protruding portion is fitted into the corresponding attachment groove 62 illustrated in FIG. 2. Thus, the position of the fixing device 20 with respect to the image forming apparatus body 10A is restricted.

In the example illustrated in FIG. 8, the restricting member 64 has such a shape as to cover the first coupling member 76*b* of the spring 76. However, the restricting member 64 may have other shape as long as it covers at least the first coupling member 76*b* of the spring 76. For example, the restricting member 64 may have such as shape as to cover the spring body 76*a* of the spring 76 or as to cover the second coupling member 76*c*.

FIGS. 7 and 8 illustrate a support 94 disposed on the first support member 70. The support 94 is described in detail below.

Figure 9:
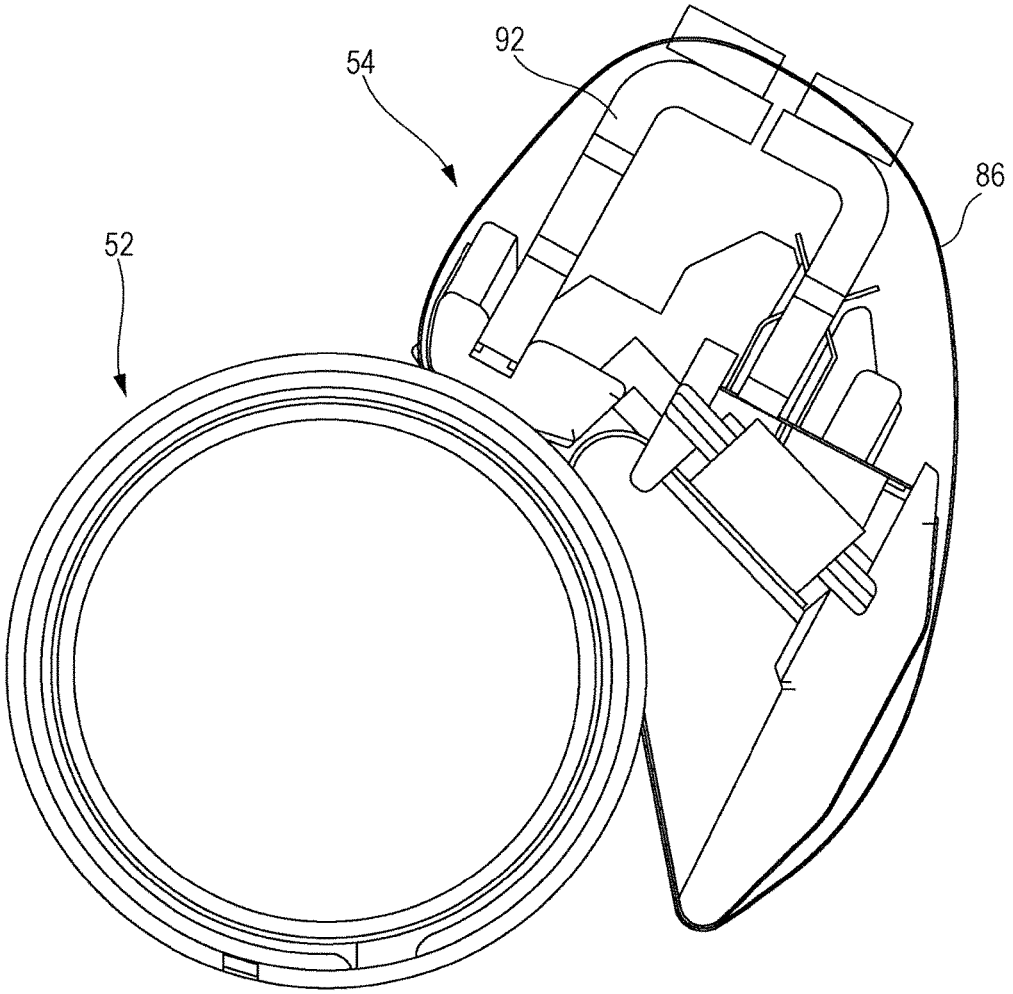
FIG. 9 is a sectional view of the fixing device taken along line IX-IX of FIG. 4.

FIG. 9 illustrates the section taken along the line IX-IX of FIG. 4. FIG. 9 does not illustrate the components other than the heating member 52 and the pressing member 54. The pressing member 54 includes a hollow cylindrical pressing belt 86 (endless belt). The hollow cylindrical pressing belt 86 holds, inside itself, a guide, a support member 92 (support plate), and a pressing pad. The pressing member 54 corresponds to an example of a rotational body.

The guide is a member that guides rotational movement of the pressing belt 86. The pressing pad is a member that presses the pressing belt 86 from the inside against the heating member 52. When a sheet P passes over an area (nip area) of the pressing belt 86 over which the pressing belt 86 is held between the pressing pad and the heating member 52 and pressed against the outer circumference of the heating member 52, the force and the heat are imposed on the sheet P.

The support member 92 integrally supports the internal structure of the pressing member 54. For example, the support member 92 supports the pressing belt 86 so that the pressing belt 86 is rotatable. When the force toward the heating member 52 is imposed on the support member 92, a pressing force is generated via the pressing pad and the pressing belt 86. The support member 92 extends further than other components (members) of the pressing member 54 at both end portions of the pressing member 54 in the apparatus depth direction D. The extending portions correspond to the end portions 90 illustrated in FIG. 5. Forcing members 72, which press the pressing member 54 against the heating member 52 via the support member 92, are attached to the end portions (end portions 90) of the pressing member 54.

Figure 10:
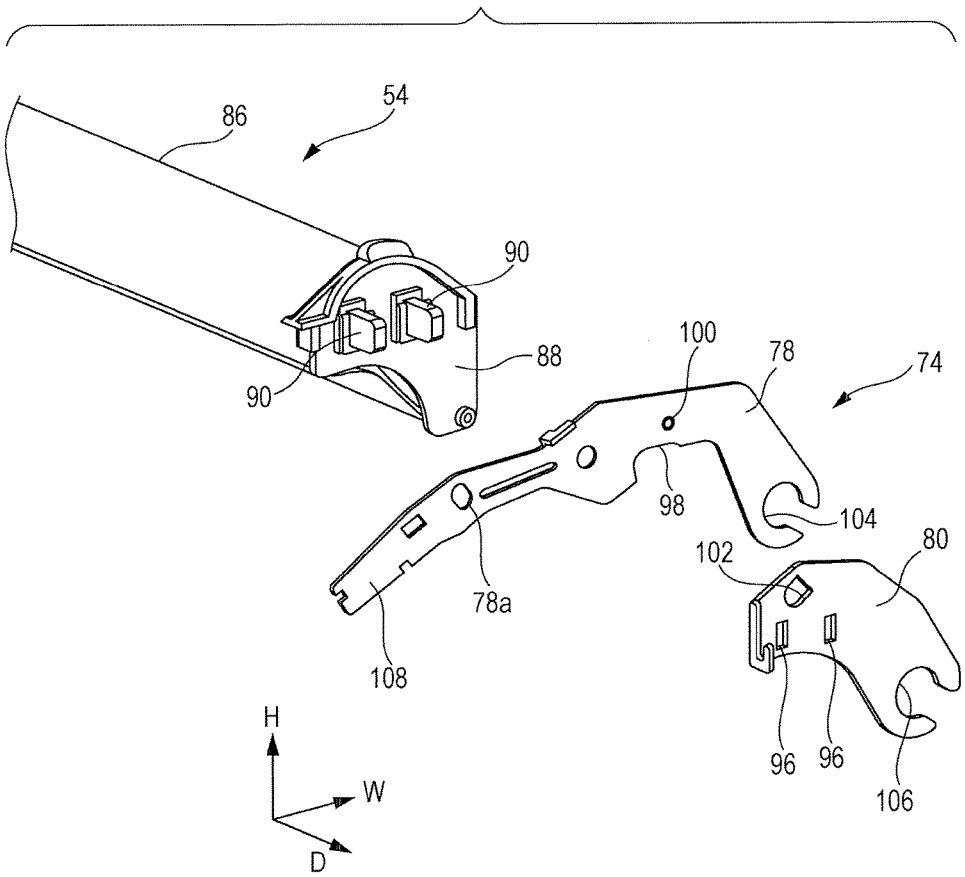
FIG. 10 is an exploded perspective view of a pressing member and a second support member.
Figure 11:
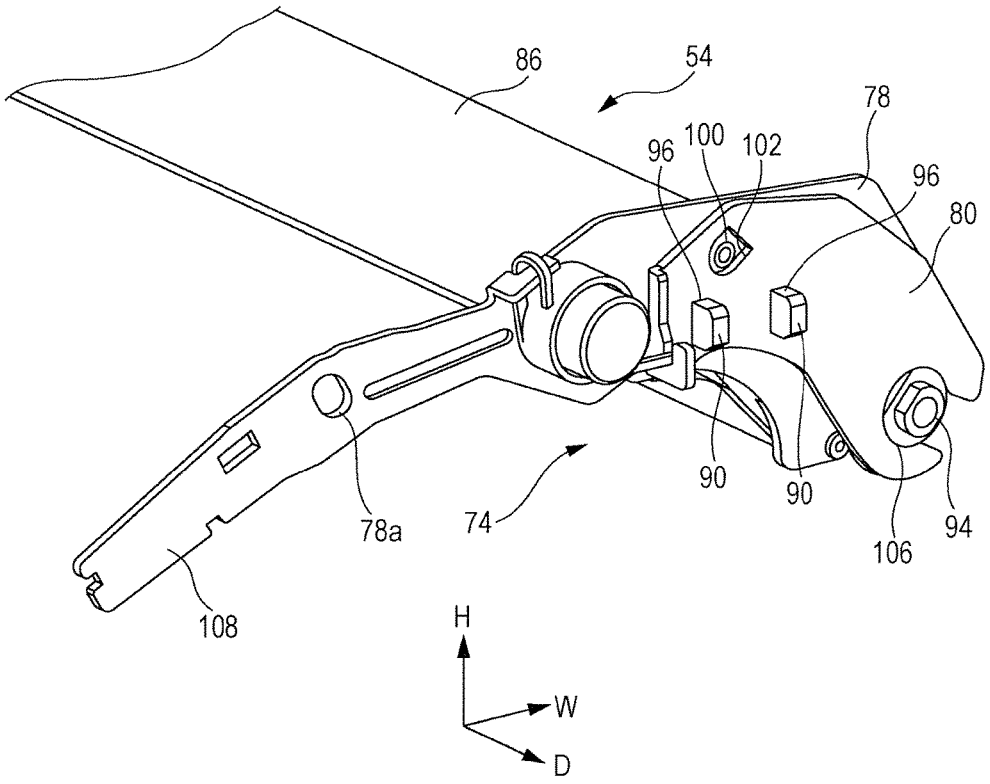
FIG. 11 is a perspective view of a pressing member and a second support member.
Figure 12:
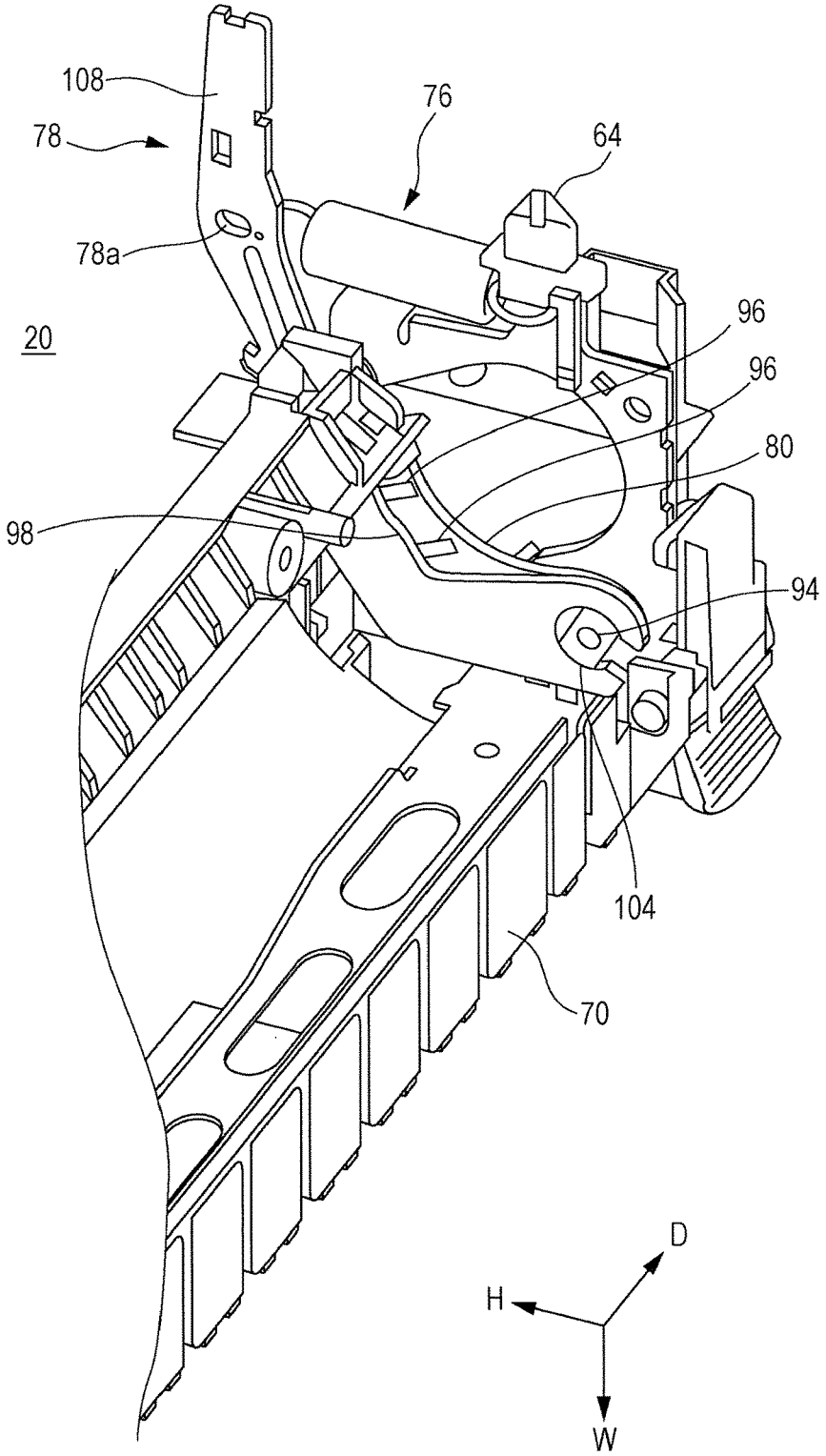
FIG. 12 is a perspective view of a first support member and a second support member.

With reference to FIGS. 10 to 12, the second support members 74 are described in details. FIG. 10 is an exploded perspective view of the pressing member 54 and one second support member 74. FIG. 11 is a perspective view of the pressing member 54 and one second support member 74. FIG. 12 is a perspective view of the first support member 70 and one second support member 74.

The second support members 74 are formed by, for example, metalworking and disposed on both ends of the pressing member 54 in the apparatus depth direction D.

Each second support member 74 includes a forcing plate 78 and a guiding plate 80. As illustrated in FIG. 12, the supports 94 are disposed on both end portions of the first support member 70 in the apparatus depth direction D. Each support 94 is, for example, a protrusion protruding to the inner side of the first support member 70 in the apparatus depth direction D. Each forcing plate 78 and each guiding plate 80 are disposed so as to be rotatable around the corresponding support 94 at the end portion of the first support member 70 in the apparatus depth direction D.

As illustrated in FIG. 10, each guiding plate 80 has guide grooves 96, which hold and guide the end portions 90 of the support member 92 (support plate) included in the pressing member 54. When the end portions 90 (end portion of the support member 92) of the pressing member 54 are inserted into the guide grooves 96, the pair of second support members 74 guide the support member 92 and support the pressing member 54.

Each forcing plate 78 includes an arch portion 98, which is pressed against the end portions 90 of the support member 92 (support plate) held between the guide grooves 96 of the guiding plate 80, and a protrusion 100, which protrudes toward the guiding plate 80.

Each guiding plate 80 also has a through hole 102, into which the protrusion 100 of the corresponding forcing plate 78 is inserted, at a position corresponding to the protrusion 100. When the forcing plate 78 and the guiding plate 80 are placed so as to overlap one on the other, the protrusion 100 of the forcing plate 78 is inserted into the through hole 102 of the guiding plate 80. Thus, the position (movement) of the guiding plate 80 with respect to the forcing plate 78 is restricted.

The forcing plate 78 has a holding groove 104 (insertion hole) rotatably held by the corresponding support 94. The guiding plate 80 has a holding groove 106 (insertion hole) rotatably held by the corresponding support 94. The holding grooves 104 and 106 are rotatably held by the same support 94 of the first support member 70. As illustrated in FIG. 12, the support 94 (protrusion), protruding in the apparatus depth direction D, is inserted into the holding grooves 104 and 106 (insertion holes). When each support 94 (protrusion) is inserted into the holding grooves 104 and 106, the pair of second support members 74 are supported so as to be rotatable around the supports 94. Specifically, the pair of second support members 74 are rotatably held (supported) by the first support member 70. Thus, the pair of second support members 74 are moved relative to the first support member 70 such that the pressing member 54 moves toward and away from the heating member 52.

The forcing plate 78 and the guiding plate 80, while touching each other, are attached to the pressing member 54 in the manner illustrated in FIG. 11.

As described above with reference to FIG. 7, each forcing plate 78 has a hook catcher 78*a*, on which the second coupling member 76*c* of the corresponding spring 76 is allowed to be hooked. The second coupling member 76*c* of the spring 76 is hooked on the hook catcher 78*a*.

Each forcing plate 78 has an operation member 108, which is operated in a direction against the urging force of the corresponding spring 76 to retract the pressing member 54. When the operation force in the direction against the urging force of the springs 76 is imposed on the operation member 108, each second support member 74 rotates around the corresponding support 94 and the pressing member 54 moves away from the heating member 52.

Figure 13:
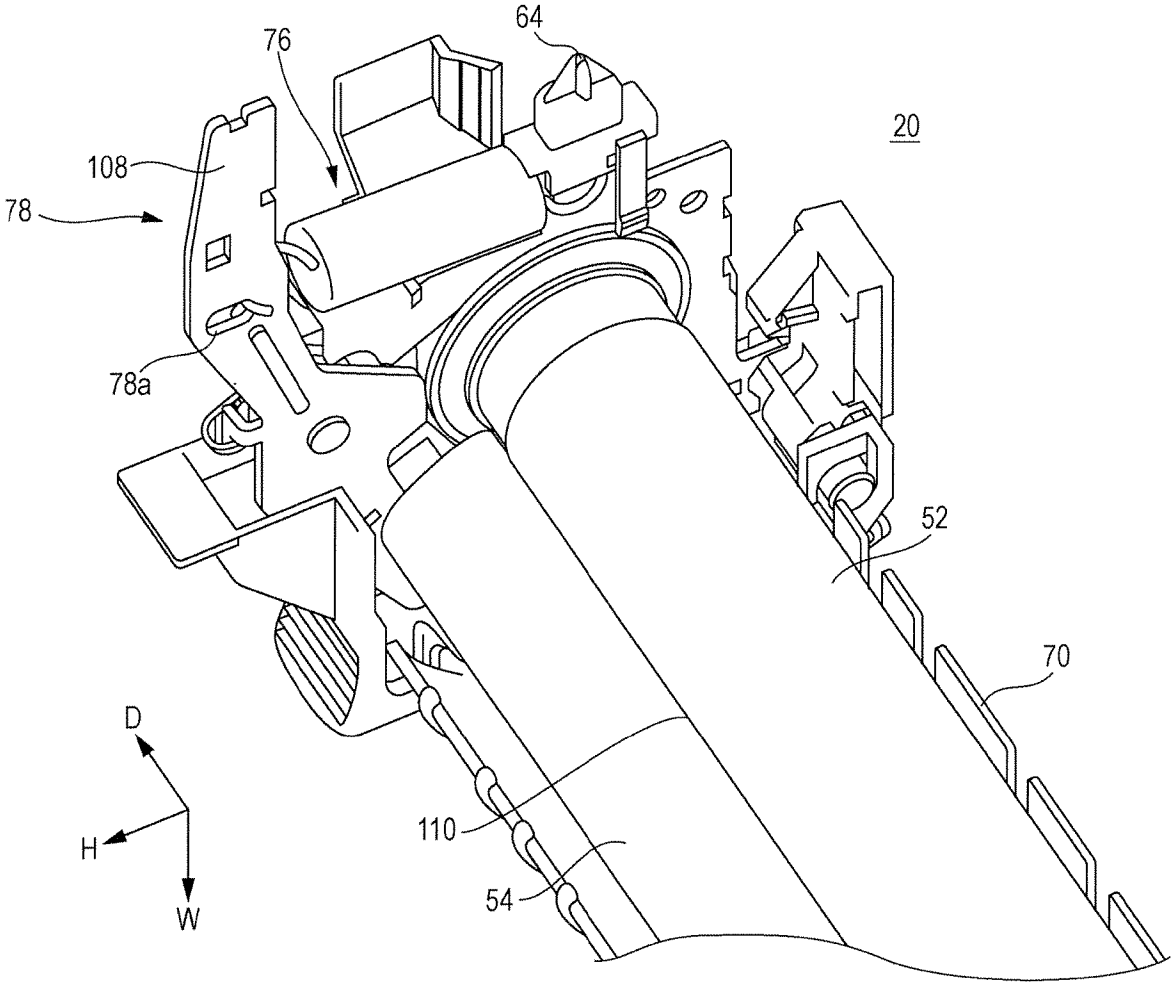
FIG. 13 is a perspective view of a portion of a fixing device.
Figure 14:
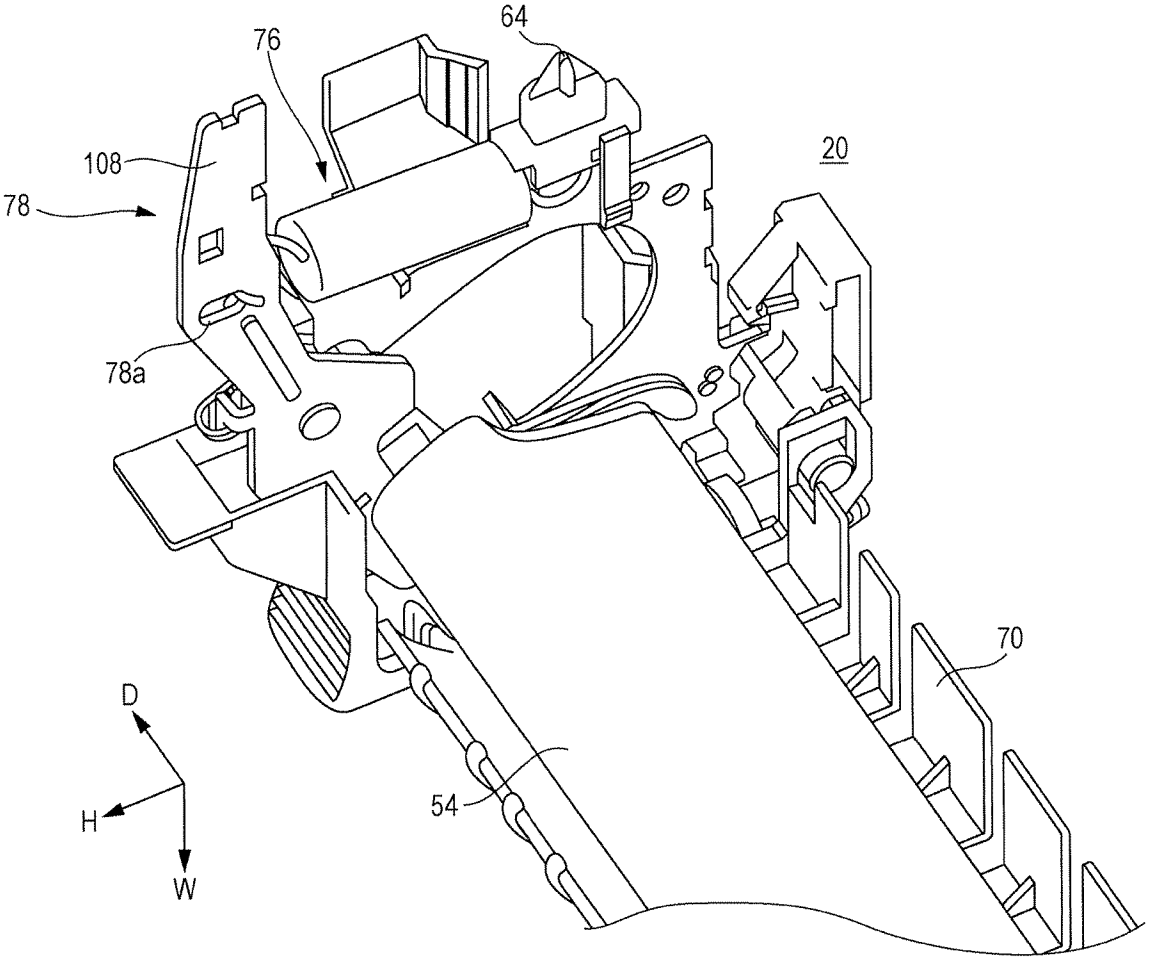
FIG. 14 is a perspective view of a portion of a fixing device.

FIG. 13 illustrates the fixing device 20 in which the heating member 52 and the pressing member 54 are attached to the first support member 70. FIG. 14 illustrates the fixing device 20 from which the heating member 52 is removed. FIGS. 13 and 14 are perspective views illustrating portions of the fixing device 20.

Each spring 76 pulls the pair of second support members 74 and the first support member 70 with its elastic force to bring the pressing member 54 into contact with the heating member 52 with pressure. Thus, as illustrated in FIG. 13, a contact area 110 (nip portion) is formed between the heating member 52 and the pressing member 54.

The pressing member 54 brought into contact with the heating member 52 with pressure is driven to rotate by the heating member 52, which is driven to rotate. Thus, the heating member 52 and the pressing member 54 hold and transport a sheet P to which toner images have been transferred, the heating member 52 heats the sheet P (toner), and the pressing member 54 presses the sheet P (toner) to fix the toner images to the sheet P.

The operations of the components such as the forcing members 72 are described. As illustrated in FIG. 4 and other drawings, the pressing member 54 is pressed (urged) against the heating member 52 by the urging force of the pair of springs 76. Specifically, the urging force of each spring 76 imposed on the corresponding second support member 74 via the hook catcher 78*a* of the second support member 74 causes, in the second support member 74, a force of rotating around the support 94. The rotating force of the second support member 74 transmits the urging force of the spring 76 to the end portion 90 of the support member 92 of the pressing member 54 through the guide groove 96 of the second support member 74. Thus, the pressing member 54 is pressed against the heating member 52. The second support member 74 corresponds to a member that transmits the urging force of the spring 76 to the pressing member 54.

Here, the pressing member 54 including the pressing belt is described as an example. Alternatively, a member that presses (urges) without using a belt member may be used, or the pressing member may be a solid cylindrical pressing roller.

Figure 15:
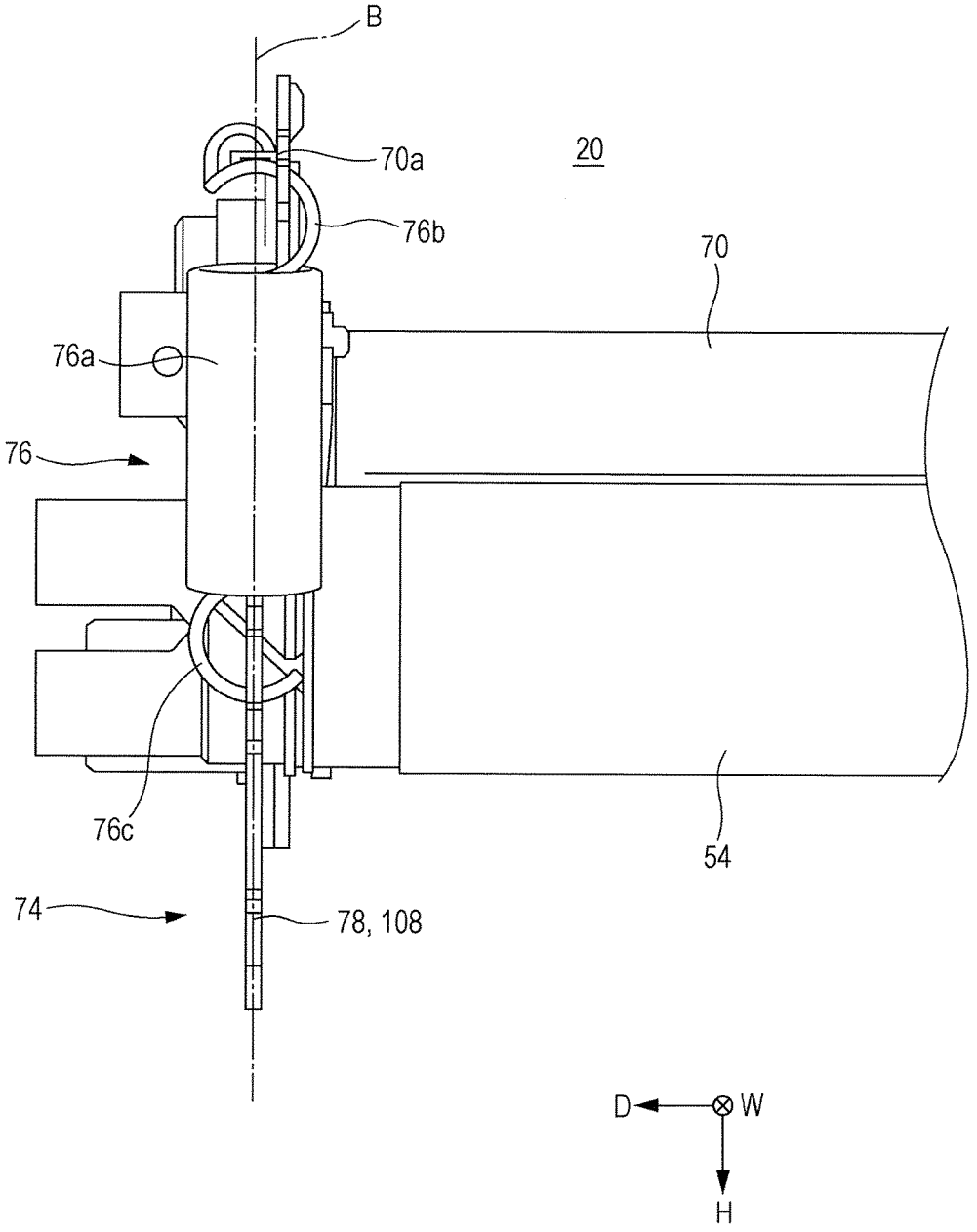
FIG. 15 is a plan view of a portion of a fixing device.
Figure 16:
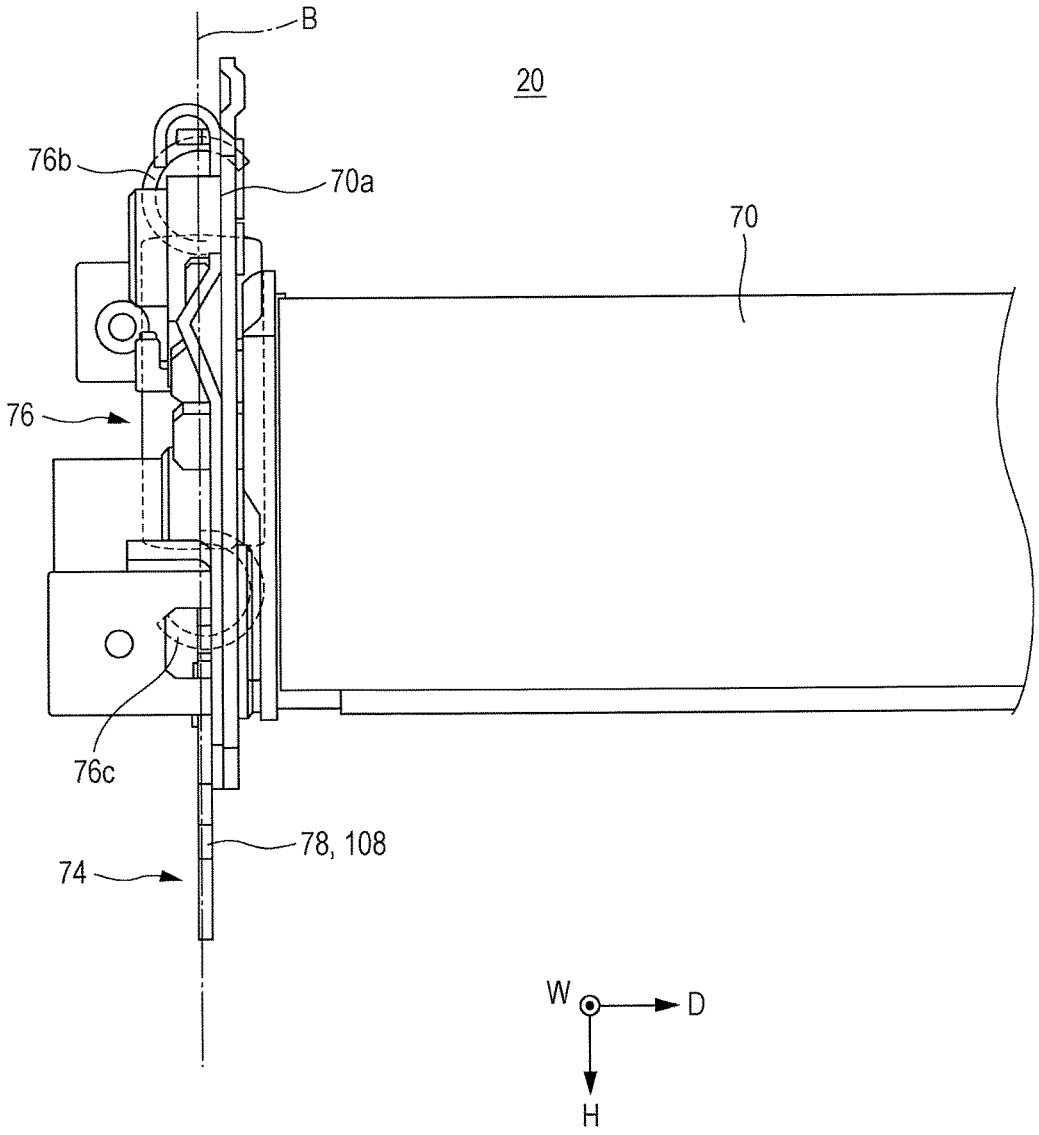
FIG. 16 is a plan view of a portion of a fixing device.

FIGS. 15 and 16 illustrate portions of the fixing device 20. FIGS. 15 and 16 are plan views of the fixing device 20. FIG. 16 is a view when the fixing device 20 in FIG. 15 is viewed from the direction opposite to the apparatus width direction W.

In the first support member 70, each protrusion 70*a* to which the corresponding restricting member 64 is attached is disposed on an extended line B connecting each of the second support members 74, disposed on both end portions of the pressing member 54, and the corresponding one of the springs 76, hooked on the second support member 74. Thus, the restricting member 64 attached to the protrusion 70*a* is disposed on the extended line B.

As described above, in the present exemplary embodiment, when the fixing device 20 is attached to the image forming apparatus body 10A, the restricting members 64 are fitted into the attachment grooves 62 (recesses) formed in the image forming apparatus body 10A. Thus, the position (movement) of the fixing device 20 with respect to the image forming apparatus body 10A is restricted and the position of the fixing device 20 with respect to the image forming apparatus body 10A is fixed.

When the fixing device 20 is disposed on the image forming apparatus body 10A, the restricting members 64 are fitted into the attachment grooves 62. Thus, the position of the fixing device 20 with respect to the image forming apparatus body 10A is fixed, and the position of each forcing member 72 (the second support members 74 and the spring 76) is restricted in accordance with the fixed position of the fixing device 20. Thus, the position (movement) of the pressing member 54 is restricted. In this manner, the pressing member 54 is prevented from being misaligned and is thus aligned properly. The following describes this point in detail.

The second support members 74 constituting the forcing members 72 are disposed on both end portions of the pressing member 54 in the apparatus depth direction D (rotational axis direction). The second support members 74 support the pressing member 54. Each spring 76 constituting the forcing member 72 is hooked on the corresponding second support member 74, and presses the pressing member 54 against the heating member 52. Each restricting member 64 is disposed so as to cover at least the first coupling member 76*b* of the corresponding spring 76. When the fixing device 20 is attached to the image forming apparatus body 10A, each restricting member 64 is fitted into the corresponding attachment groove 62, so that the position (movement) of the restricting member 64 is restricted. Restricting the position of each restricting member 64 restricts the position (movement) of the spring 76 at least part of which is covered by the restricting member 64, for example, the position in the apparatus depth direction D (movement in the apparatus depth direction D). Restricting the position of each spring 76 restricts the position (movement) of each second support member 74 on which the corresponding spring 76 is hooked, for example, the position in the apparatus depth direction D (movement in the apparatus depth direction D). Restricting the position of the second support members 74 restricts the position (movement) of the pressing member 54 supported by the second support members 74, for example, the position in the apparatus depth direction D, or the rotational axis direction (movement in the apparatus depth direction D). In this manner, attaching the fixing device 20 to the image forming apparatus body 10A restricts the positions of the forcing members 72 and thus restricts the position of the pressing member 54 to enable automatic alignment.

Each restricting member 64 is disposed on the extended line B connecting the corresponding spring 76 and the corresponding second support member 74 to each other to restrict the position (movement) of the spring 76 in the apparatus depth direction D. For example, the tilt of the spring 76 in the apparatus depth direction D from the extended line B is restricted, and thus, the tilt of the second support member 74 in the apparatus depth direction D from the extended line B is restricted. Since the tilt of each forcing member 72 (the second support members 74 and the spring 76) is restricted, the misalignment of the pressing member 54 attributable to the tilt is prevented, so that the pressing member 54 is aligned properly. The tilt of each spring 76 in the apparatus depth direction D possibly results from, for example, the misalignment of the spring 76 in the apparatus depth direction D.

As each restricting member 64 covers a larger portion of the corresponding spring 76, that is, as each restricting member 64 restricts the position of a larger portion, the tilt of the spring 76 is further restricted (prevented). Thus, the misalignment of the pressing member 54 resulting from the tilt is more reliably prevented. For example, when the first coupling member 76*b* and the spring body 76*a* are covered by the restricting member 64 and their positions are restricted, the tilt of the spring 76 is more reliably restricted (prevented) than in the case where only the first coupling member 76*b* is covered and restricted by the restricting member 64. Here, the misalignment of the pressing member 54 is more reliably prevented. When, besides the first coupling member 76*b* and the spring body 76*a*, the second coupling member 76*c* is also covered by the restricting member 64 and its position is restricted by the restricting member 64, the misalignment of the pressing member 54 is more reliably prevented.

When each restricting member 64 covers at least the first coupling member 76*b* of the corresponding spring 76, the spring 76 is less likely to come off the first support member 70. For example, when the first coupling member 76*b* has a C-hook shape, the spring 76 is less likely to come off the first support member 70, even when the C-hook shape is small. The first coupling member 76*b* having a small C-hook shape facilitates an attachment of the spring 76 to the first support member 70 compared to the case of the first coupling member 76*b* having a large C-hook shape. Thus, the fixing device 20 is more efficiently assembled (specifically, the spring 76 is more easily attached to the first support member 70).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a first fixing member;

a second fixing member that fixes a toner image transferred to a recording medium onto the recording medium by transporting the recording medium while holding the recording medium between the first fixing member and the second fixing member;

a first support member that supports the first fixing member;

a forcing member that supports the second fixing member and presses the second fixing member against the first fixing member; and a restricting member disposed on the first support member to fix a position of the first support member at an attachable member to which the first support member is attached, and the restricting member covers at least a portion of the forcing member to restrict a position of the forcing member, the restricting member is not configured to couple with the forcing member.

2. The fixing device according to claim 1, wherein the restricting member restricts a position of the forcing member in a direction crossing a transportation direction of the recording medium.

3. The fixing device according to claim 2, wherein the second fixing member is a rotational body, wherein the direction crossing the transportation direction of the recording medium is a rotational axis direction of the second fixing member, and wherein the restricting member restricts a position of the forcing member in the rotational axis direction of the second fixing member.

4. The fixing device according to claim 3, wherein the restricting member includes two restricting members located at portions of the first support member corresponding to two end portions of the second fixing member in the rotational axis direction.

5. The fixing device according to claim 3, wherein the forcing member includes second support members disposed on two end portions of the second fixing member in the rotational axis direction to support the second fixing member, and disposed movable with respect to the first support member, and springs coupled to the first support member and respectively to the second support members, wherein the second support members are members that transmit loads imposed by the springs to the second fixing member, and wherein the restricting member restricts a position of the forcing member by restricting a tilt of the springs in the rotational axis direction of the second fixing member.

6. The fixing device according to claim 5, wherein the restricting member is disposed on the first support member so as to cover at least an end portion of each spring.

7. The fixing device according to claim 6, wherein each of the springs includes a spring body serving as an elastic member, a first coupling member disposed at a first end portion of the spring body and coupled to the first support member, and a second coupling member disposed at a second end portion of the spring body and coupled to a corresponding one of the second support members, and wherein the restricting member is disposed on the first support member so as to cover at least the first coupling member.

8. The fixing device according to claim 5, wherein the restricting member is disposed on an extended line connecting each spring to the corresponding one of the second support members.

9. The fixing device according to claim 1, wherein the restricting member fixes the position of the first support member at the attachable member when the first support member is disposed on the attachable member, and restricts the position of the forcing member in accordance with the fixed position.

10. The fixing device according to claim 1, wherein the restricting member restricts the position of the forcing member as a result of being fitted to a restricting portion disposed at the attachable member.

11. The fixing device according to claim 10, wherein the restricting member has such a shape as to protrude from the first support member, wherein the restricting portion is a groove formed in the attachable member, and wherein the restricting member restricts the position of the forcing member as a result of being fitted into the groove.

12. An image forming apparatus, comprising:

an image forming apparatus body including a transfer device that transfers a toner image to a recording medium; and a fixing device that is removable from the image forming apparatus body, the fixing device fixing the toner image transferred to the recording medium by the transfer device onto the recording medium, wherein the fixing device includes a first fixing member, a second fixing member that fixes the toner image transferred to the recording medium onto the recording medium by transporting the recording medium while holding the recording medium between the first fixing member and the second fixing member, a first support member that supports the first fixing member, a forcing member that supports the second fixing member and presses the second fixing member against the first fixing member, and a restricting member disposed on the first support member to fix a position of the first support member at the image forming apparatus body, and the restricting member covers at least a portion of the forcing member to restrict a position of the forcing member, the restricting member is not configured to couple with the forcing member.

* * * * *